US009121616B1

(12) United States Patent
Woodall, II

(10) Patent No.: US 9,121,616 B1
(45) Date of Patent: Sep. 1, 2015

(54) SYSTEMS AND METHODS FOR COLLECTING AND REMOVING COOKING BYPRODUCTS IN A KITCHEN VENTILATION SYSTEM

(71) Applicant: Vent-A-Hood, Ltd., Richardson, TX (US)

(72) Inventor: William Miles Woodall, II, Dallas, TX (US)

(73) Assignee: Vent-A-Hood, Ltd., Richardson, TX (US)

( * ) Notice: Subject to any disclaimer, the term of this patent is extended or adjusted under 35 U.S.C. 154(b) by 357 days.

(21) Appl. No.: 13/663,151

(22) Filed: Oct. 29, 2012

Related U.S. Application Data

(60) Provisional application No. 61/628,350, filed on Oct. 28, 2011.

(51) Int. Cl.
*A47J 36/38* (2006.01)
*F24C 15/20* (2006.01)

(52) U.S. Cl.
CPC ..... *F24C 15/20* (2013.01)

(58) Field of Classification Search
CPC ..... F24C 15/20; F24C 15/2021
USPC ..... 126/299 D, 299 E, 299 R; 310/62; 55/408
See application file for complete search history.

(56) References Cited

U.S. PATENT DOCUMENTS

| | | | | |
|---|---|---|---|---|
| 3,248,858 | A * | 5/1966 | Toke | 96/249 |
| 3,732,802 | A * | 5/1973 | Kristof | 126/299 D |
| 6,142,142 | A * | 11/2000 | Woodall et al. | 126/299 R |
| 6,820,609 | B2 * | 11/2004 | Woodall et al. | 126/299 R |
| 2007/0101985 | A1 * | 5/2007 | Yeung | 126/299 D |

* cited by examiner

*Primary Examiner* — Avinash Savani
(74) *Attorney, Agent, or Firm* — James J. Murphy; Thomas & Knight LLP

(57) ABSTRACT

A blower for use in a kitchen ventilation system includes a set of blades driven by a motor for moving air containing cooking byproducts from a surrounding area and separating out cooking byproducts. A housing at least partially encompasses the set of blades and captures the separated cooking byproducts. A tray engages with the housing, which includes a reservoir for accumulating the captured cooking byproducts, wherein the tray is separable from the housing to allow discarding of the accumulated cooking byproducts.

18 Claims, 3 Drawing Sheets

SYSTEMS AND METHODS FOR COLLECTING AND REMOVING COOKING BYPRODUCTS IN A KITCHEN VENTILATION SYSTEM

CROSS-REFERENCE TO RELATED APPLICATION

The present application claims the benefit of U.S. Provisional Patent Application Ser. No. 61/628,350, filed Oct. 28, 2012.

FIELD OF INVENTION

The present invention relates in general to kitchen ventilation systems and in particular to systems and methods for collecting and removing cooking byproducts in a kitchen ventilation system.

BACKGROUND OF INVENTION

Cooking creates undesirable by-products such as smoke, grease and odor that can pollute an inhabited airspace if they are not removed or reclaimed. Consequently, many devices have been invented for addressing the problem of airborne cooking contaminants. For example, ducted range hoods remove the contaminated air from the inhabited area, while ductless range hoods intake air from the cooking area, remove at least some of the contaminants, and then re-circulate the resulting exhaust air back into the inhabited space.

Grease is one particularly difficult problem to address in any type of ventilation system. Among other things, liquefied grease removed from the air can accumulate in hard-to-reach areas of the ventilation system, where it can become rancid, support the growth of fungus or bacteria, attract insects, or even present a fire hazard. The average American household typically must address over a gallon of cooking grease every year and commercial kitchens significantly more.

While cleaning the ventilation system of grease is mandatory for maintaining hygiene and safety, whether it is in a home or commercial kitchen, the structure and assembly of currently available ventilation systems often make removal of accumulated grease a time-consuming and painstaking task. For example, in some ventilation systems employing a blower to remove airborne grease through liquefaction, the blow unit must be accessed in the ventilation system and at least the blower housing removed and washed. While removing and washing the blow housing, the user must take care to avoid spilling grease along with particulate matter trapped within the grease.

SUMMARY OF INVENTION

According to one embodiment of the present inventive principles, a blower is disclosed for use in a kitchen ventilation system includes a set of blades driven by a motor for moving air containing cooking byproducts from a surrounding area and separating out cooking byproducts. A housing at least partially encompasses the set of blades and captures the separated cooking byproducts. A tray engages with the housing, which includes a reservoir for accumulating the captured cooking byproducts, wherein the tray is separable from the housing to allow discarding of the accumulated cooking byproducts.

The embodiments of the principles of the present invention advantageously allow collected grease and particulate matter to be easily and quickly removed from the blower of a kitchen ventilation system. A removable shield-assembly simply slides away from the bottom of blower housing and the accumulated cooking byproducts within the shield-tray reservoir discarded. For a more thorough cleaning of the blower unit, the blower housing can also be removed using simple latches.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
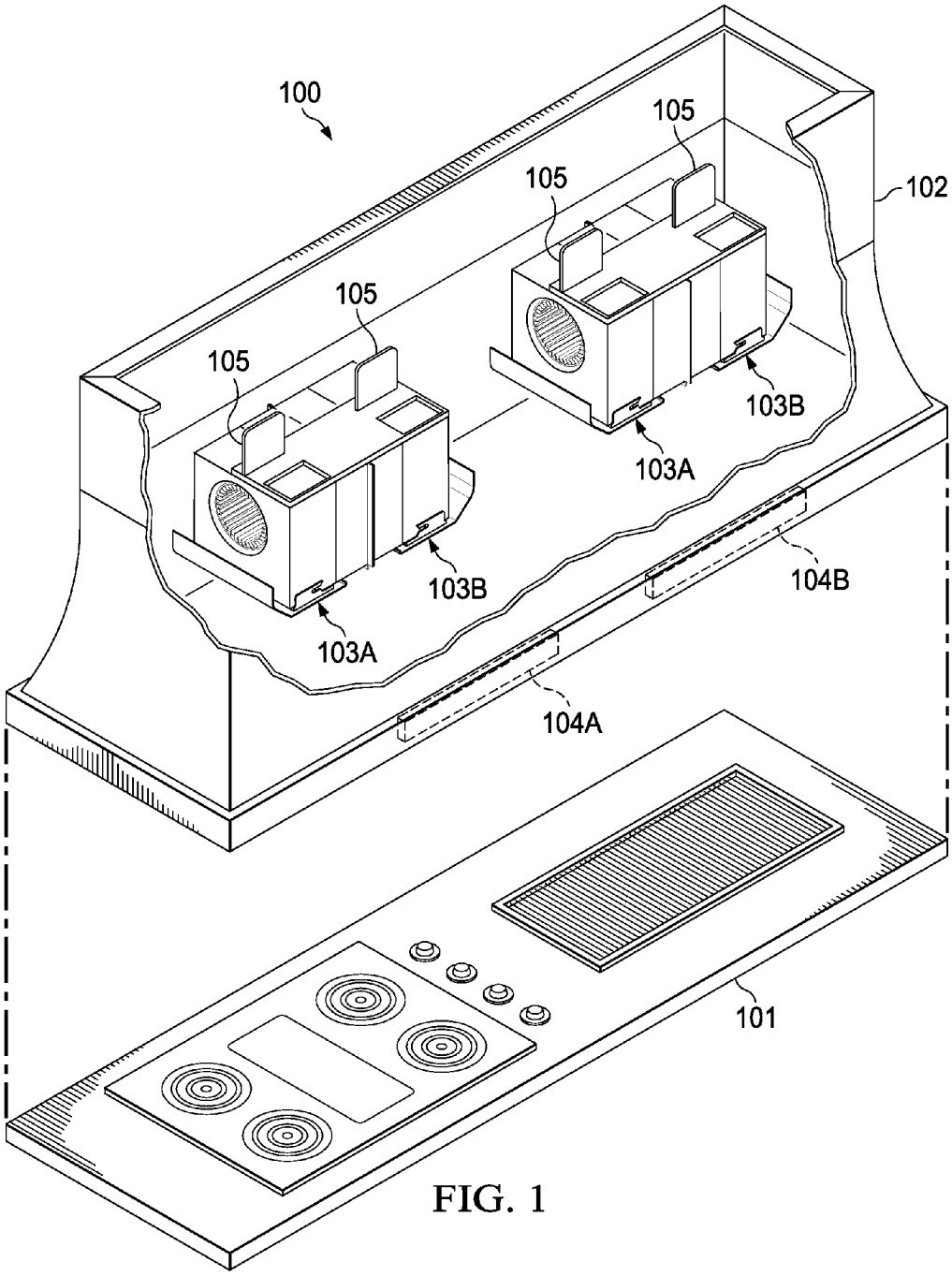
FIG. 1 is a diagram of a representative cooking hood assembly, embodying the principles of the present invention, shown in a typical home cooking environment.

The principles of the present invention and their advantages are best understood by referring to the illustrated embodiment depicted in FIGS. 1-2 of the drawings, in which like numbers designate like parts.

FIG. 1 is a diagram of an exemplary ducted hood system 100 embodying the principles of the present invention. Hood system 100 is shown disposed over a conventional home kitchen stove and grill unit 101, which during normal cooking generates cooking byproducts including grease, odors, and smoke. While hood system 100 is shown a larger home kitchen environment, the present inventive principles are not limited thereto, and may be applied to other environments, such as commercial kitchens and smaller household kitchens. In addition to stoves, the cooking byproducts can be generated by other nearby cooking appliances, such as frying pans and similar electric apparatus. It should also be recognized that while exemplary hood system 100 is a ducted system, the principles of the present invention discussed below are equally applicable to ductless hood systems.

Exemplary hood system 100 includes a hood 102, which is appropriately sized to capture cooking byproducts generated during the use of stove and grill 101, including heat, steam, odors, and grease. The size and shape of hood 102 can vary widely, depending on the desired aesthetics, the size of the underlying appliances, the size of the kitchen, as so on. The surfaces of hood 102 exposed to stove and grill 101 are preferably metal, for example stainless steel, although the outer surfaces may be enclosed in wood, plastic, or a similar material providing the desired aesthetics.

Representative hood system 100 is a multiple-blower system, including two (2) pairs of back-to-back blower units 103A and 103B. The number of blower units 103 may vary depending on the particular application. For example, only a single blower 103 may be required to meet the ventilation requirements of a small household kitchen, while multiple blowers 103, along with a larger hood 102, may be required to cover multiple household cooking surfaces or commercial kitchen equipment. In each case, tradeoffs typically must be made, with hood systems with a higher airflow able to handle larger kitchen environments, at the expense of producing more noise.

Lights 104A and 104B are also included in exemplary hood system 100, and may utilize fluorescent, incandescent, halogen or other types of standard light bulbs or tubes. Automatic dampers 105 prevent back-draft from the outside environment through the associated ducting (not shown).

Figure 2A:
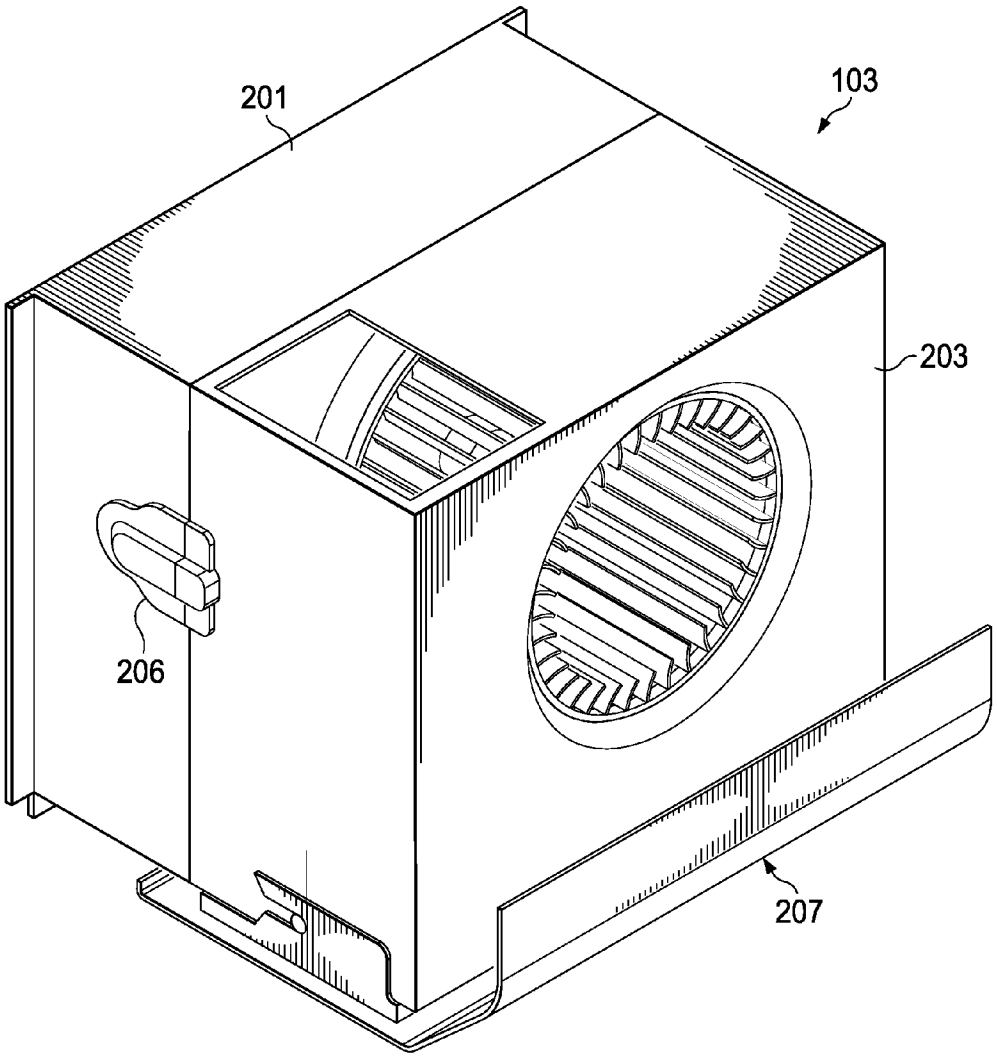
FIG. 2A is a diagram showing a selected one of the blower units of FIG. 1 according to the principles of the present invention.
Figure 2B:
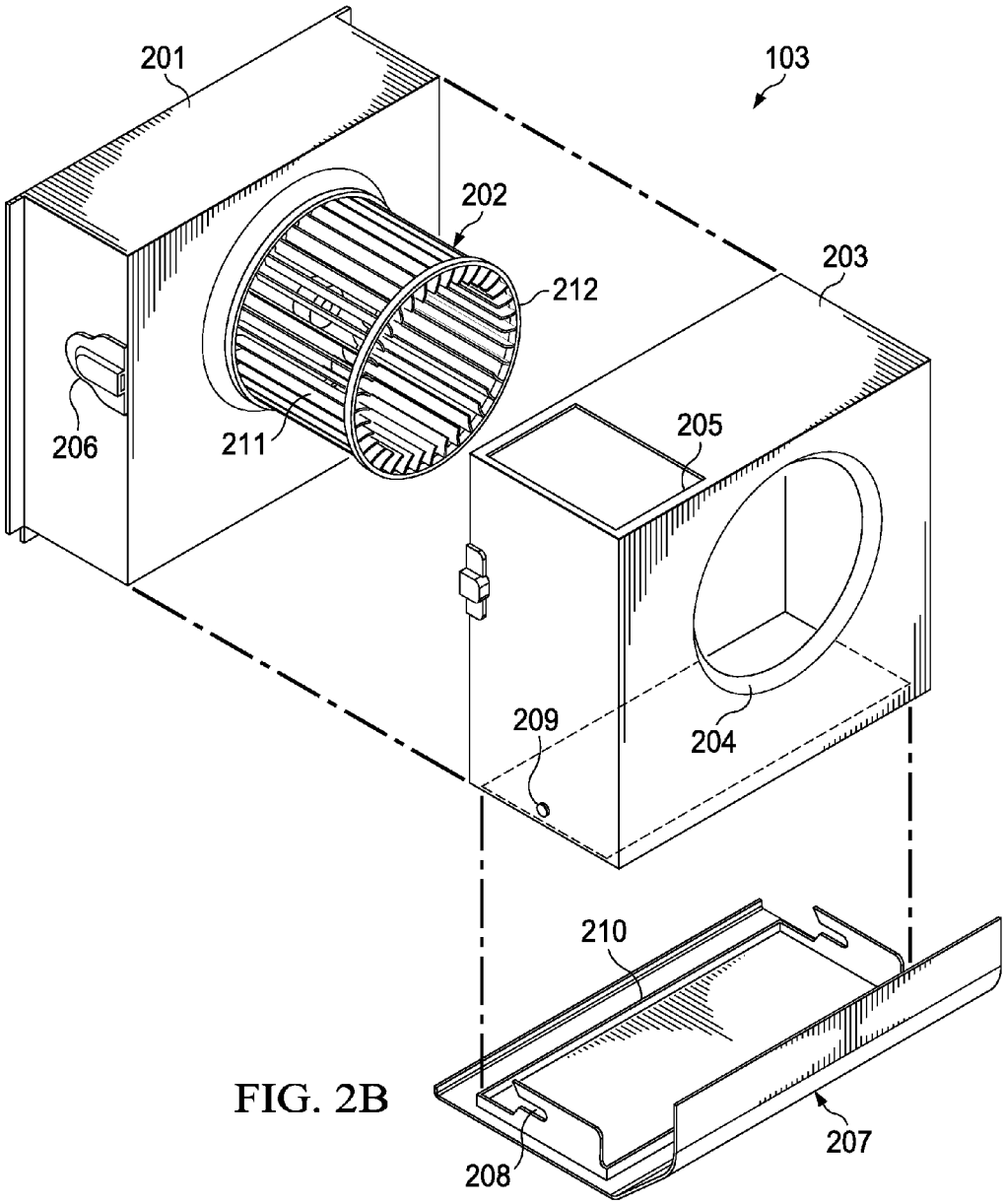
FIG. 2B is a diagram showing the blower unit of FIG. 2A partially disassembled for cleaning according to the principles of the present invention.

FIGS. 2A and 2B respectively show an assembled and partially disassembled blower unit 103 according to the principles of the present invention. Blower unit 103 includes a rear section 201 containing a motor, which drives a squirrel cage 202. Squirrel cage 202 includes a set of blades 211 supported by a pair of rings 212. Blades 211 are angled with respect to the axis of rotation of squirrel cage 202. In the embodiment of FIGS. 2A and 2B, the axis of rotation of squirrel cage 202 is generally disposed horizontally to the bottom of blower unit 103 after blower unit 103 is installed within hood system 100.

In operation, squirrel cage 202 is maintained within a housing 203, which includes an aperture 204 for receiving heated vapors and an exhaust aperture 205, which exhausts vapors depleted of grease and particulates to the associated ducting. A latch 206 on each side of blower unit 103 allows housing 203 to be separated from rear section 201 and squirrel cage 202 to be accessed. Rear section 201 and housing 203 are preferably constructed of metal, for example, stainless steel sheeting. Together, the motor within rear section 201 and squirrel cage 202 implement two important functions: (1) ventilating the area around stove and grill 101 by evacuating air containing cooking byproducts; and (2) separating grease and particulate matter within the evacuated air through liquefaction.

The lower surface of housing 203 includes and aperture, shown by dashed lines in FIG. 2B, which is covered during operation by a removable shield-tray assembly 207. Shield-tray assembly 207 includes upward extending tabs 208 with horizontal slots for engaging corresponding posts 209 on each side of housing 203. A reservoir (pan) 210 is provided on the upper surface of removable shield-tray assembly 207 and corresponds with the aperture in the lower surface of housing 203 for receiving liquefied grease and particulates separated from the incoming flow of vapors by squirrel cage 202. Preferably, the sidewalls of reservoir 210 are dimensioned to correspond to the aperture though the lower surface of housing 203 to minimize leakage of the separated byproducts from blower unit 103.

Removable shield-tray assembly 207 also prevents exposure to the spinning squirrel cage 202 and balances airflow into the blower unit. Removable shield-tray assembly 207 is also preferably constructed of metal, although other materials can also be used, such as plastics, which are resistant to heat, cooking byproducts, and cleaning products. In the embodiment of FIGS. 2A and 2B, the axis of rotation of squirrel cage 202 is disposed generally parallel to the upper surface of reservoir 210 when shield-tray assembly 207 is fastened to housing 203.

Specifically, the centrifugal action of spinning squirrel cage 202 separates grease from the heated vapors entering aperture 204 in blower housing 203 by liquefaction. The liquefied grease, and any other solid or liquid cooking byproducts separated from the incoming vapors, are cast to the parabolic internal walls (not shown) of housing 203 and then settle to reservoir 210 on removable shield-tray assembly 207. Typically, a blower speed of approximately 1550 rpm maintains a suitable pressure to liquefy grease vapor from the received heated vapors. Centrifugal-action grease separation units, such as blower unit 103, advantageously require less airflow than ventilation systems utilizing mesh or baffle filtration, and thus are very quiet during operation. A complete description of the operation and control of blower 103 is provided in co-assigned U.S. Pat. No. 6,142,142, incorporated herein by reference for all purposes.

As shown in FIG. 2B, disposal of grease trapped within housing 203 of blower 103 only requires removing shield-tray assembly 207 and discarding the contents of receptacle 210. In particular, power is first disconnected from blower unit 103 to prevent activation of the motor and squirrel cage 202. Shield-tray assembly 207 is pulled away horizontally from housing 203 such that posts 209 on housing 203 disengage with the slots on tab 208 of shield-tray assembly 207. Care is preferably taken to keep tray-assembly 207 level to prevent spillage of the contents of reservoir 210. The accumulated grease and particulate matter within reservoir 210 is then appropriately discarded. Shield-tray assembly 207 may then be washed or cleaned with water and soap or detergent, either by and or with a dishwasher, and then reconnected to housing 203 via posts 209.

Housing 203 may also be separated from rear section 201 by unlatching latches 206 and carefully pulling housing 203 past squirrel cage 202. Housing 203 may then be washed or cleaned, for example with water and soap or detergent. As necessary, squirrel cage 202 may also be removed with a hex wrench and similarly cleaned.

The principles of the present invention are equally applicable for easily and efficiently removing and discarding grease and other cooking byproducts accumulated during the operation of other types of blower systems. For example, shield-tray assembly 207 can be advantageously used in connection with the low-profile blower-grease separator units disclosed in co-assigned U.S. Pat. No. 6,820,609, which is incorporated herein by reference for all purposes. In this case, the surface of reservoir 210 of shield-tray assembly 207 is disposed under and generally orthogonal to the axis of rotation of the squirrel cage.

In sum, the principles of the present invention are embodied in apparatus and methods that allow collected grease and particulate matter to be easily and quickly removed from the blower of a kitchen ventilation system. A removable shield-assembly simply slides away from the bottom of blower housing and the accumulated cooking byproducts within the shield-tray reservoir discarded. For a more thorough cleaning of the blower unit, the blower housing can also be removed using simple latches.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A blower for use in a kitchen ventilation system comprising:

set of blades driven by a motor for moving air containing cooking byproducts from a surrounding area and separating cooking byproducts therefrom;

a housing least partially encompassing the set of blades for capturing the separated cooking byproducts; and a tray adapted to engage with the housing and having a reservoir for accumulating the captured separated cooking byproducts, wherein the tray is separable from the housing to allow discarding of the accumulated captured separated cooking byproducts, wherein the tray includes a surface for disposition parallel to a side of the housing when the tray and the housing are engaged and a tab extending at an angle to the surface, the tab including a slot for receiving a corresponding post extending at an angle from a surface of the housing for engaging the tray with the housing.

2. The blower of claim 1, wherein the tray further comprises sidewalls extending from the surface of the tray to define a reservoir, wherein the reservoir receives the accumulated cooking byproducts through an aperture through the side of the housing when the tray and the housing are engaged.

3. The blower of claim 2, wherein the side of the housing is disposed at an angle to a second side of the housing having an aperture for receiving air moved by the set of blades, and wherein the tray further includes a shield extending at an angle from the surface of the tray for preventing access to the set of blades when the tray and the housing are engaged.

4. The blower of claim 1, wherein the set of blades form a portion of a squirrel cage.

5. The blower of claim 4, wherein the blades of the squirrel cage rotate around an axis, the axis disposed generally parallel to the surface of the tray when the tray and the housing are engaged.

6. The blower of claim 1, wherein the cooking byproducts include vaporized grease and the set of blades are operable to separate the vaporized grease from the air by liquefaction when the blades are driven by the motor.

7. The blower of claim 1, further comprising a latch for engaging the housing with a second housing encompassing the motor and supporting the set of blades, the latch allowing the housing to be separated from the blower for cleaning.

8. A blower for a kitchen ventilation system comprising:

a first portion including a squirrel cage driven by a motor for separating vaporized grease from an airflow by liquefaction;

a housing least partially encompassing the squirrel cage for capturing the liquefied grease, a first housing face having a first housing aperture through which the air flows and a second housing face having a second housing aperture; and a removable assembly for engaging the housing with a surface adjacent to the second housing face and supporting a reservoir for accumulating liquefied grease passing through the second housing aperture, a shield extending at an angle from the surface of the removable assembly providing a shield against exposure to the squirrel cage through the first housing aperture during operation of the blower, and wherein the housing further includes a third housing face disposed at angles to the first and second housing faces, a post extending from the third housing face for engaging a slot in a tab extending at an angle from the surface of the removable assembly to engage the housing and the removable assembly such that the removable assembly can be disengaged from the housing for discarding accumulated liquefied grease within the reservoir.

9. The blower of claim 8, wherein the squirrel cage rotates around an axis, the axis disposed generally in parallel to the surface of the removable assembly.

10. The blower of claim 8, further comprising a latch for engaging the first portion of the blower with the housing and allowing the housing and the blower to be selectively disengaged for cleaning.

11. The blower of claim 8, wherein the removable assembly is fabricated of metal.

12. A kitchen ventilation system for removing cooking byproducts generated during cooking comprising:

a hood for capturing air containing kitchen byproducts generated during cooking in an underlying area;

a blower disposed within the hood comprising:

set of blades driven by a motor for drawing the air containing the cooking byproducts into the hood and separating out grease by liquefaction;

a housing encompassing the set of blades for capturing the liquefied grease and including a side with a post extending at an angle therefrom; and a tray for engaging with the housing and having a reservoir for accumulating the captured liquefied grease and having a tab adapted to extend substantially in parallel to the side of the housing when the tray is engaged with the housing, the tab including a slot for receiving the post on the housing wherein the tray is slidably separable from the housing to allow discarding of the accumulated liquefied grease.

13. The kitchen ventilation system of claim 12, wherein the kitchen ventilation system comprises a ducted ventilation system comprising a duct in fluid communication with an exhaust port of the blower.

14. The kitchen ventilation system of claim 12 wherein the blower comprises one of a plurality of like blowers.

15. The kitchen ventilation system of claim 12, wherein the set of blades comprises the blades of a squirrel cage.

16. The kitchen ventilation system of claim 12, wherein an upper surface of the tray slidably engages a bottom face of the housing.

17. The kitchen ventilation system of claim 16, wherein the squirrel cage rotates around an axis of rotation disposed in parallel to the upper surface of the tray when the tray is engaged with the housing.

18. The kitchen ventilations system of claim 12, further wherein the set of blades are exposed through an aperture through a face of the housing and the tray further comprises a shield for shielding the set of blades.

* * * * *

UNITED STATES PATENT AND TRADEMARK OFFICE

CERTIFICATE OF CORRECTION

PATENT NO. : 9,121,616 B1
APPLICATION NO. : 13/663151
DATED : September 1, 2015
INVENTOR(S) : William Miles Woodall, II It is certified that error appears in the above-identified patent and that said Letters Patent is hereby corrected as shown below:

ON THE TITLE PAGE
(74) Attorney, Agent, or Firm should read - James J. Murphy, Thompson & Knight LLP IN THE SPECIFICATION
Column 1, lines 9-11, Approximately should read
CROSS-REFERENCE TO RELATED APPLICATION
The present application claims the benefit of U.S. Provisional Patent Application Ser. No. 61/628,350, filed October 28, 2011.

Signed and Sealed this
Twenty-second Day of March, 2016

Michelle K. Lee

Michelle K. Lee
*Director of the United States Patent and Trademark Office*